US010238154B2

(12) United States Patent
Delaney

(10) Patent No.: US 10,238,154 B2
(45) Date of Patent: Mar. 26, 2019

(54) OUTER GARMENTS FOR WOMEN

(71) Applicant: Wet Leopard Pty Ltd, Sydney, New South Wales (AU)

(72) Inventor: Alison Delaney, Sydney (AU)

(73) Assignee: WET LEOPARD PTY LTD (AU)

( * ) Notice: Subject to any disclaimer, the term of this patent is extended or adjusted under 35 U.S.C. 154(b) by 0 days.

(21) Appl. No.: 15/566,243

(22) PCT Filed: Apr. 13, 2016

(86) PCT No.: PCT/IB2016/052088

§ 371 (c)(1),
(2) Date: Oct. 13, 2017

(87) PCT Pub. No.: WO2016/166671

PCT Pub. Date: Oct. 20, 2016

(65) Prior Publication Data

US 2018/0055097 A1 Mar. 1, 2018

(30) Foreign Application Priority Data

Apr. 13, 2015 (AU) ..... 2015901303

(51) Int. Cl.

| | |
|---|---|
| ***A41C 3/08*** | (2006.01) |
| ***A41C 1/06*** | (2006.01) |
| ***A41D 7/00*** | (2006.01) |
| ***A41B 1/08*** | (2006.01) |
| ***A41C 3/00*** | (2006.01) |
| ***A41D 13/012*** | (2006.01) |

(52) U.S. Cl.

CPC ..... *A41C 3/08* (2013.01); *A41B 1/08* (2013.01); *A41C 1/06* (2013.01); *A41C 3/0007* (2013.01); *A41D 7/006* (2013.01); *A41D 13/012* (2013.01); *A41D 2400/26* (2013.01)

(58) Field of Classification Search

CPC ..... A41B 1/08; A41C 3/06; A41C 3/0007
USPC ..... 450/30–31, 7, 8, 11, 12; 2/105, 106, 67, 2/69

See application file for complete search history.

(56) References Cited

U.S. PATENT DOCUMENTS

| | | | | | |
|---|---|---|---|---|---|
| 3,628,539 | A | * | 12/1971 | Fredricks | A41C 3/148 450/3 |
| 4,798,557 | A | | 1/1989 | Scott | |
| 4,916,755 | A | * | 4/1990 | Feigenbaum | A41D 7/00 2/67 |
| 5,033,986 | A | * | 7/1991 | Feigenbaum | A41C 3/0057 2/67 |
| 5,459,875 | A | * | 10/1995 | Fattorusso | A41D 7/00 2/247 |

(Continued)

OTHER PUBLICATIONS

International Search Report dated Jun. 24, 2016 for corresponding International Application No. PCT/IB2016/052088.

*Primary Examiner* — Gloria Hale
(74) *Attorney, Agent, or Firm* — Tarolli, Sundheim, Covell & Tummino LLP

(57) ABSTRACT

An outer garment, in particular sports or beach wear, such as a rash guard, adapted for women is provided. More particularly, the garment is suitable for active wear as it has in-built bust support comprising underwiring. The outer garment comprises an outer fabric shell configured to substantially cover a wearer's shoulders and to which a bust-support structure is secured.

19 Claims, 3 Drawing Sheets

(56) References Cited

U.S. PATENT DOCUMENTS

| | | | | |
|---|---|---|---|---|
| 5,678,246 | A * | 10/1997 | Cooley | A41D 7/00 2/67 |
| 5,946,726 | A | 9/1999 | Green | |
| 6,165,045 | A | 12/2000 | Miller et al. | |
| 6,292,947 | B1 * | 9/2001 | Bechis | A41C 3/0057 2/67 |
| 6,530,820 | B1 | 3/2003 | Katze et al. | |
| 7,083,494 | B2 * | 8/2006 | Sandroussi | A41C 3/0014 2/105 |
| 8,900,032 | B2 | 12/2014 | Punsal | |
| 2006/0242748 | A1 | 11/2006 | Martz | |
| 2008/0141430 | A1 * | 6/2008 | Rance | A41D 7/00 2/67 |
| 2008/0256675 | A1 * | 10/2008 | Di Lorenzo | A41D 7/00 2/67 |
| 2009/0038047 | A1 * | 2/2009 | Di Lorenzo | A41D 7/005 2/67 |
| 2009/0151041 | A1 * | 6/2009 | Moberly | A41D 13/012 2/67 |
| 2011/0021113 | A1 * | 1/2011 | Hilfman | A41C 3/08 450/31 |
| 2013/0303049 | A1 * | 11/2013 | Jackson | A41C 3/08 450/30 |
| 2014/0134922 | A1 * | 5/2014 | Hearty | A41C 3/08 450/31 |
| 2014/0273734 | A1 * | 9/2014 | Gordon | A41C 1/06 450/7 |

* cited by examiner

OUTER GARMENTS FOR WOMEN

RELATED APPLICATIONS

The present invention is a U.S. National Stage under 35 USC 371 patent application, claiming priority to Ser. No. PCT/IB2016/052088, filed on 13 Apr. 2016; which claims priority from AU 2015901303, filed 13 Apr. 2015, the entirety of both of which are incorporated herein by reference.

FIELD OF INVENTION

This invention relates to outer garments, in particular sports or beach wear, such as a rash guard, adapted for women. More particularly, it provides a garment suitable for active wear with bust support.

BACKGROUND TO THE INVENTION

A rash guard, also known as a rash vest or even abbreviated to 'rashie', is a shirt-like garment providing protection for the wearer against sunburn and associated skin damage and the development of adverse skin conditions from rubbing or chafing against a water-sports device such as a body-board or surfboard. It is popular with surfers and body-boarders in warm water conditions.

The use of rash guards has developed and expanded to become considered a form of general beachwear, becoming popular as a sun protection garment for children. Use among adults too has increased. The rashguard is evolving into a leisure garment suitable for activities and environments other than the beach, to the extent that it is becoming a fashion item for various post-beach and early-evening social occasions.

A segment of the potential market appears to have been ignored however, namely that of practically half the adult population—women—and in particular women with obvious busts. Modesty, physical health and comfort considerations oblige many members of this segment to don an item of underwear or a suitably supportive bikini top or a one-piece swimsuit to support and/or restrain or confine their breasts. This choice itself has its drawbacks—comfort and aesthetics among them. Rash guards being made from lightweight, moisture-wicking fabrics such as spandex, tend to have superior drying capabilities to the items of underwear such as brassieres and supportive bikini tops. The resultant uneven drying rate also leads to discomfort.

Another disadvantage of having to wear a bikini top under the rash guard is that the rash guard tends to move over and raise itself up above the bikini top whilst a woman is swimming or performing routine activities, causing the wearer repeated manual adjustments to realign both the rash guard and bikini top. The separate bikini top or bra worn underneath the rash guard also cause unsightly bulges and give an unkempt look.

An alternative is for the woman to not wear a bikini or bra underneath the rash guard. This may be acceptable for some women, but is a definite disadvantage for larger breasted women who require breast support, and for most women performing sports such as running, yoga, canoeing, windsurfing or other physical activities during which additional breast support is sought. Accordingly, there is a need for a women's rash guard that provides constant built-in bra cups and underwire support for the breasts.

Prior patent publications have not provided a solution. A US patent to Edelman, U.S. Pat. No. 2,510,012, describes an underwired brassiere that may be incorporated into a swimsuit or a foundation garment. It has shoulder straps or boning in the torso strap to provide vertical support to drape the fabric of the breast cups over the breasts of the wearer. The underwiring diverges from stitching that supports the breasts towards the wearer's arms.

U.S. Pat. No. 4,875,236 to Boynton describes a garment designed to be close fitting, so as to prevent or at least greatly inhibit breast movement, essentially by pressing the breasts against the wearer's torso. This type of garment does not support the breasts in a near-natural orientation that assists the supportive muscular structure of the wearer. This is a feature of some athletic swimsuits that provide stronger bust support through achieving a close fit to the body during athletic activity and movement (such as in the sport of diving), and serves in keeping the swimsuit in place, In online fashion forums, women are asking others for ideas on what to wear under a rash guard for bust support, some indicating they need to wear a bra or a conventional underwire bikini top. In light of the evolving uses and acceptability of the rash guard beyond the traditional beach environment, the term "rash guard" in this specification, including the claims, is intended to be interpreted widely and encompass these applications.

OBJECTS OF THE INVENTION

It is an object of this invention to address the shortcomings of the prior art and, in doing so, to provide, in one garment, an underwired outer garment that combines the support and comfort of a bra with the style and functionality of a leisure wear item.

A further object of the invention is to provide a bust-supporting garment that provides protection against sun exposure.

The preceding discussion of the background to the invention is intended to facilitate an understanding of the present invention. However, it should be appreciated that the discussion is not an acknowledgement or admission that any of the material referred to was part of the common general knowledge in Australia or elsewhere as at the priority date of the present application.

Further, and unless the context clearly requires otherwise, throughout the description and the claims, the words 'comprise', 'comprising', and the like are to be construed in an inclusive sense—that is to say, in the sense of "including, but not being limited to"—as opposed to an exclusive or exhaustive sense—that is to say meaning "including this and nothing else".

SUMMARY OF INVENTION

According to a first aspect of the invention, there is provided an outer garment comprising an outer fabric shell configured to substantially cover a wearer's shoulders and an internal bust-supporting structure fastened to the outer fabric shell, said structure comprising an underwiring element.

In a preferred form of the invention, the bust-supporting structure comprises a pair of breast-receiving cups, each cup being securely fastened to the outer fabric shell.

The outer shell preferably comprises a 4-way stretch fabric.

The structure further comprises linking means providing a bridging connection between the cups. The bridging connection is attached to opposed adjacent proximal edges of the respective cups. The bridging connection in use is located substantially centrally between the wearer's breasts. In an embodiment, the bridging connection is provided in two parts, each part having one end connected to a cup and the other to a zipper passing between the cups.

In a preferred form of the invention, the bust-supporting structure is in the form of a loop extending about the torso of a wearer.

The loop of the bust-supporting structure further comprises a strap having opposite ends to each of which said respective breast-receiving cups are secured at their distally located edges, for providing support to the breasts of a wearer when the cups are adjacently located in operative orientation to provide desired support.

In an embodiment, the strap comprises an extensible, resilient material. The strap is sized to pass around the back of the wearer. In doing so, the strap elastically biases the structure to tension the cups to be drawn away from each other at their proximate linked edges.

In a further preferred form of the invention, the outer garment shell includes panels of fabric having differing density. Preferably, the panels have differing stretch characteristics.

In a preferred form of the invention, the cups comprise an outer fabric shell provided by the outer fabric shell of the garment, and an inner lining.

The lining is preferably a substantially non-stretching material compared with the fabric of the outer shell. A preferred material is polymer foam wadding material. Non-limiting examples are dacron and polyester. The lining may alternatively comprise whipped silicone or a gel, as known in the art.

Still further, in this invention, the outer fabric shell of the cups preferably comprises a stabilising material with low-stretch characteristics.

The outer garment further comprises underwiring associated with each bra cup in the bust-supporting structure.

In a preferred embodiment, each cup comprises a sewn-in bra casing for receiving a U-shaped elongate underwiring element. The casing may take the form of a sleeve extending peripherally about a lower portion of the cup.

The underwiring element preferably comprises an alloy selected for biocompatibility with body tissue, for example grade 316 stainless steel. Alternatively, it comprises a rigid plastics or polycarbonate compound suitable for exposure to UV radiation and salt water without substantial degrading. An example of such a plastics compound is polyethylene. The polycarbonate is desirably free of bisphenol A (BPA) and includes a stabilser for ultraviolet light.

In an embodiment, the strap comprises a length of elastically resilient material, for example rubber or a synthetic rubber substitute.

In a preferred embodiment, the strap comprises a single length of said material having opposed ends.

Alternatively, the strap may comprise first and second connectible portions and connecting means for interconnecting them. The interconnecting means may be a clasp, as is familiar in the brassiere art, or fastening means such as mating hook-and-loop fastening strips.

Preferably, between each strap end and the respective cup is a piece of intermediate connecting material.

Optionally, in an embodiment, the strap includes boning in the connecting material. When used, the boning is inserted proximate to the strap ends that are connected to the bra cups.

In a further preferred form of the invention, the strap is free of direct attachment to the outer shell.

Still further preferably in this invention, the outer shell comprises a front fabric panel, a rear fabric panel and a pair of discrete side panels, each side panel being connected to said front panel and rear panel, thereby to define a torso-receiving space.

The side panels are preferably of different fabric density to the front and rear panels. In a preferred embodiment the fabric density of the front and rear panels exceeds that of the side panels. Preferably, the fabric of the side panels has a greater degree of stretchability than the back panel and the front panel.

The front panel in an embodiment comprises an upper portion and a lower portion. Preferably, the upper and lower portions of the front panel comprise respective fabrics of different density.

The density of the side panels is in the range from 80 gsm to 360 gsm.

The density of the front and rear panels is preferably in the range from 200 gsm to 500 gsm.

The outer garment is desirably made of fabric having an ultraviolet protection factor of at least 40, preferably at least UPF 50.

BRIEF DESCRIPTION OF DRAWINGS

In order that the invention may be readily understood, and put into practical effect, reference will now be made to the accompanying figures. Thus.

DETAILED DESCRIPTION OF AN EMBODIMENT OF THE INVENTION

Figure 1:
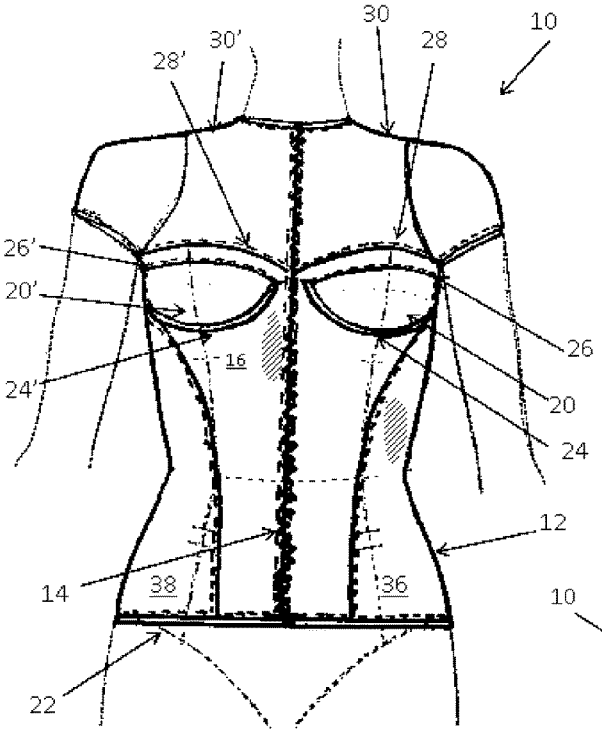
FIG. 1 shows (a) front and (b) rear views of a preferred embodiment of the outer garment of this invention being worn by a model, and FIG. 1(*c*) a view of an internal rear fastening strap.
Figure 1:
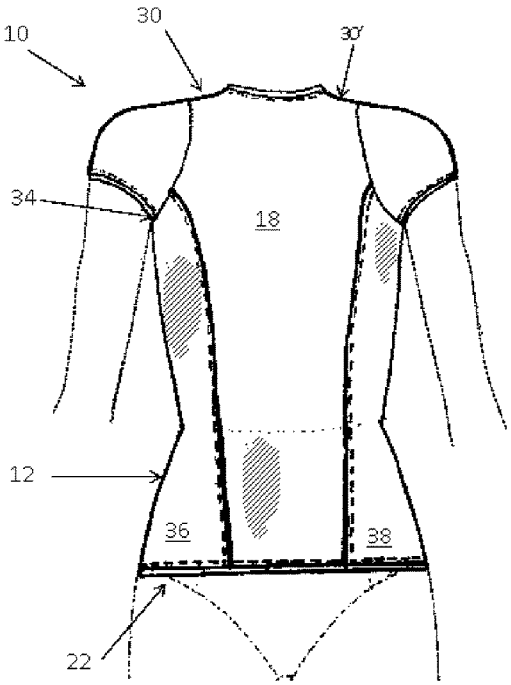
Figure 1:
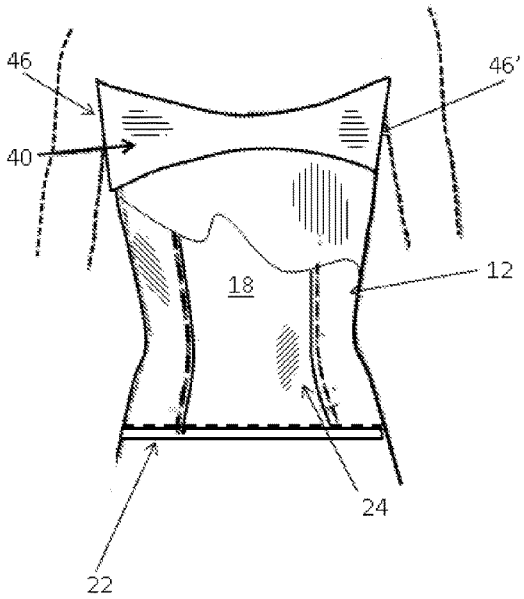

The outer garment of the present invention is intended in its most preferred embodiments to be worn as women's active wear that also provides significant sun protection. However, the concept underpinning this invention makes it suitable for application in a wide range of garments—especially those with sleeves, whether short or long.

In terms of active wear, the inventive outer garment differs significantly from existing garments: These prior garments may well provide sun protection, but this comes without consideration for the female form. For example, existing rash guards for women do not provide any meaningful support, lift or shaping for or of the breasts. Many a female user therefore feels driven to wear a bikini top or bra underneath, particularly if she has large breasts, and desires the level of support that is now designed into this invention. No undergarment or foundation garment need therefore be worn beneath the garment of this invention.

As noted above, the rash guard is gaining acceptability and attraction as a fashion garment for wearing well beyond the beach and the sports arena. Hence the term "rash guard", as used in in this specification, is intended to be interpreted widely and encompass these additional applications.

The garment of the invention includes an outer shell garment having a front fabric panel, preferably extending in one piece from the shoulder to the lower extremity of the garment, be it in the form of a tank top, a shirt or an single piece leotard. A breast supporting structure is arranged to integrate with the outer shell. The structure comprises respective left and right cups stitched against the inner surface of the panel.

Each cup comprises a sheet of polymer foam, preferably of the closed cell type to minimise water absorption. Underwiring is secured to the cup along the arc defined by its lower periphery. The arc is substantially a semicircle in extent, having an arc angle in the range from 130° to 200°, preferably from 160° to 180°.

The result is an all-in-one form-fit shirt, dress, rash guard or swim top for women. The invention provides a fashioned look that does not create visible bumps or bulges from the layers of bikini or bra that would conventionally be worn underneath. This gives an overall neater and form-fitting appearance. Also, when adapted for primary use outdoors by using high ultraviolet radiation protection factor (UPF) fabric for the panels on shoulders and arms, back and chest, it provides a women's top that has a high-fashion, feminine look, while providing optimal sun protection. The look of the garment can be updated as fashion requires, without departing from the concept of the supportive structure being integratedly inbuilt.

The fabric is selected from those falling in the protection category 'Excellent', according to Australian Standard AS/NZS 4399 for sun protective clothing. The rating system is published on the website of the Australian Radiation Protection and Nuclear Safety Agency (ARPANSA) at:

http://www.arpansa.gov.au/radiationprotection/fact-sheets/is_UVProtection.cfm

Fabrics falling in the 'Excellent' category have an ultraviolet radiation protection factor (UPF) of at least 40. According to UPF standards, a garment with a UPF rating of 40 will reduce solar UVR exposure to the skin beneath the garment by a factor of 40. This means a UPF 40 fabric will only allow one fortieth of the UVR to pass through it. It will block 97.5% of incident UV. Accordingly, a UPF 50 garment allows only one fiftieth to pass. Preferably, the garment of this invention, because of its intended use being in and around water, has a rating of UPF 50 or higher.

The fabric is preferably spandex, but various moisture wicking fabrics of UPF 50 and higher present suitable alternatives. Examples include, without limitation, stretch fabrics in nylon, elastane (also known as "spandex"), polyester, cotton and polycotton; blends such as cotton/spandex, polyester/cotton spandex, polyester/spandex, poly/viscose/spandex and nylon/spandex; composite combinations such as nylon polyurethane.

Referring to FIG. 1, in a preferred embodiment of this invention, there is depicted a rash guard of the invention, denoted generally by the number 10. A front view is illustrated in FIG. 1 (*a*) and a rear elevation in FIG. 1(*b*). The rash guard comprises a fabric shell 12 made up of components described further below.

Prominent in the front view is a zipper 14, which divides a front main panel 16. Readers will appreciate that the zipper could instead be located in back panel 18 in FIG. 1(*b*). The zipper may also be replaced by a suitable alternative fastening means, such as a hook-and-loop connector (often referred to by means of the brand name Velcro®), press studs, or buttons and like means known in the art. In a sleeved leotard configuration, the zipper would not extend entirely to the crotch area, but only a partial way down the front panel.

In the embodiment of FIG. 1, the front and back panels extend upwardly from a continuously body-encircling lower hem 22 to meet at the apical line 30, 30' extending along generally the top of the wearer's shoulders. The front and back panels 16, 18 are made of 340 gsm supportive stretch fabric. The fabric is desirably spandex, but could alternatively be made from any of the other fabrics mentioned above, as well as from others known in the textile industry, depending on the intended end user's application. The fabric density is selected for providing a desired balance between support and stretch. A desirable degree of stretch as measured according to British Standard BS 14704-1:2005 is tabulated below.

| Elasticity dynamometer | Force [N] | Width [cm] | Toll.+/− | Length [cm] | Toll.+/− |
|---|---|---|---|---|---|
| Extension BS 14704-1:2005 | 15.0 | 70 | 20% | 50 | 20% |
| Extension BS 14704-1:2005 | 35.0 | 105 | 20% | 75 | 20% |

An elongation test indicates the height and width of the fabric when stretched. It is expressed as a percentage of the original values. The test is carried out with an electronic dynamometer on a sample of fabric. The fabric has been subjected to two tests: applying a 15 Newton weight (the ideal reference for fabrics used for swimwear) and applying a 35 Newton weight (the ideal reference for fabrics used for underwear).

An example of a desirable fabric for use in the front and rear panels of this invention is labelled 'P BFT2" and sold under the trade mark SENSITIVE SUPERFAST+CLAS BOND by Eurojersey SPA of Via S. Giovanni Bosco, 260-21042 Caronno Pertusella (Va) Italy.

The bust-support structure comprises paired individual bra-cups 20, 20' built into shell 12. Each cup is defined by inner and outer layers of fabric, as will be described below. The outer layer is provided by the front panel 16 of outer garment shell 12. Positionally, each cup is integrated into the outer shell by a respective lower hem 24, 24, that coincides with the lower peripheral edge of cup 20, 20'. Above, each cup has a transverse mid-upper seam 26, 26'. An upper seam 28, 28' extends generally parallel with the mid-upper seam, and provides reinforcement for the connection between the outer shell fabric and the fabric of the cup. A fabric strip 35, located between respective seam pairs 26, 26' and 28, 28', extends from each side, across the wearer's chest to be stitched to zipper 14.

In alternative embodiments in which the zipper is not positioned centrally to divide front panel 16, the inter-seam fabric strip 35 from each cup is either connected to the other in a central region of the panel, or strip 35 may be continuous fabric. Preferably, strip 35 has limited stretch, in order to maintain a desirable maximum distance of breast separation when under longitudinal tension by the back strap or band 40 extending from the outer edges of the respective cups and around the back of the wearer, as shown in FIG. 1(*c*).

Figure 2:
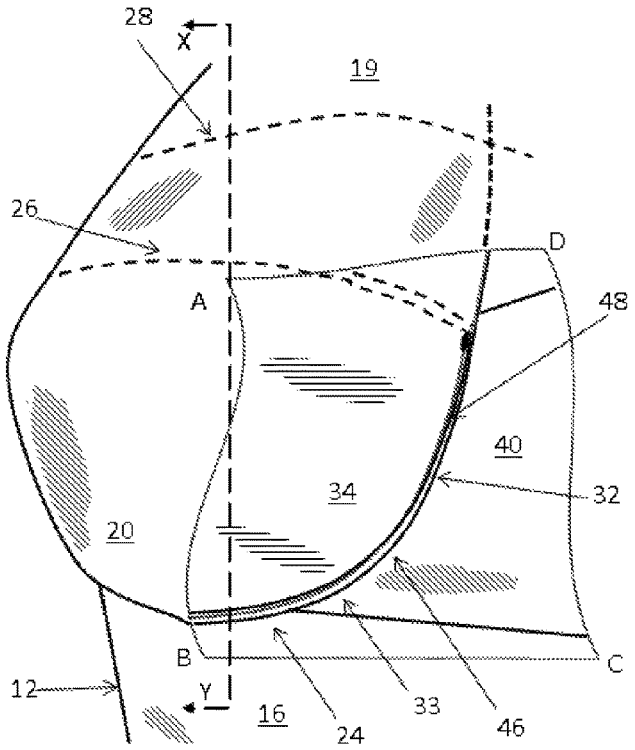
FIG. 2 shows in (a) a schematic cutaway view of internal features of the garment of the invention and in (b) a cross sectional profile along broken line X-Y in (a).
Figure 2B:
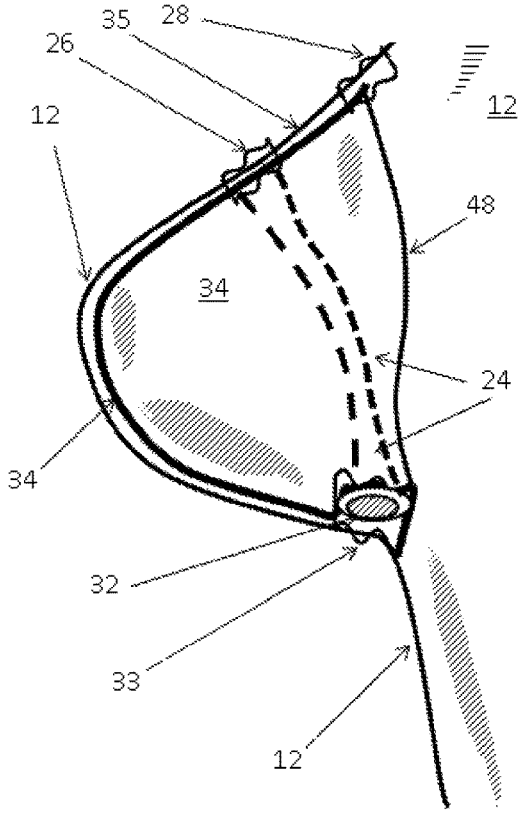

Support for each cup is provided by a curved, generally U-shaped underwiring element 32, 32' which is inserted into a casing 33. The casing is stitched to the internal fabric that defines the cup. FIG. 2(*a*) illustrates in cutaway form, defined by the shape ABCD, the internal structure of the cup assembly found below outer shell fabric 12. A cross section of the structure is depicted schematically in FIG. 2(*b*).

Within outer shell 12, each cup 20 comprises is lined internally with a non-stretch polyester foam fabric 34. Sewn between the front zipper and underwire casing 33 is a layer of a stabilising fabric 52 to provide non-stretch support to the wearer's bust.

In this embodiment, stabiliser fabric 52 is a low- or non-stretch fabric made from the fibre nylon but in other embodiments, an example of an alternative fabric that may be used is polyester. An example of a fabric for use in the lining is 100% nylon, of approximate density 44 gsm, and available as 'Tricot Stabiliser K-12154' from Charles Parsons & Co Pty Ltd, of 191-193 Cleveland Street, Redfern, NSW 2016, Australia.

The stabilised cup shells are then securely fastened to the external layer of spandex that covers the bra area in general and defines outer shell 12, so that the garment has a uniform and continuous outer appearance from neckline to lower hem 22. The continuity of appearance is interrupted only by the exterior visible portions of the stitching in fastening and stabilising seams 24/24' 26/26' and 28/28'. The internal structure, although not entirely undetectable to the astute observer, does not unduly draw attention to its presence.

In this embodiment, the rash guard comprises further panels of fabric connected by stitching to the main front and back panels 16, 18. Forming a fabric link between generally downwardly extending opposed left and right edges of these main panels are respective left and right side panels 36, 38. These extend from lower hemline 22 upwardly to end immediately below the wearer's respective arms at 34.

A back strap 40 is provided as a single piece, made of 340 gsm supportive stretch fabric. It is connected and sewn to bra cup outer edges 48, 48'. The strap has opposite ends 46, 46' connected with the outer edge 48, 48' of respective cups 20, 20'. The back strap is smaller in girth (extending across the back of the wearer, inside shell 12) than the back of the garment shell. This arrangement creates lateral tension that exerts sideways pull on the cups, and therefore effective support to the underwiring of the cup at edge 48, 48' proximate to which the respective end 46, 46' of the strap is attached.

The strap has reinforcement in the form of an additional elastic rubber strip in a length sewn across the top-end of the strap. This construction provides additional support and tension but also is stretchable across the wearer's back, affording her improved flexibility for movement when required.

It is important to note that the back strap ends 46, 46' are secured to the internal bra cup sides, and are not directly attached to outer shell 12, allowing the strap to remain independent of support and movement of the outer shell. The result is that relative movement of the shell, in relation to the wearer's back, shoulders and other parts of the torso during use, does not cause displacement of the breast supporting structure comprising the strap and cups. As an optional addition, boning (not shown) may be inserted inside the back strap to assist in bust support, and to help prevent the strap twisting. Where used, the optional boning is fitted in the straps close to the strap ends connected to the cups.

The use of thicker 340 gsm fabric on the bra-cups, back strap, and front and back panels, provides firm support to the user and assists in keeping the garment in place.

A lighter fabric of 250 gsm, selected in this embodiment for the side panels and arms, has more stretch than the 340 gsm and provides greater ease of movement and comfort, yet also assists in keeping the garment in place, by virtue of a snug body fit.

In an alternative embodiment, the portion of the chest panel fabric for the areas above the cups but below the shoulders, is of a lighter stretchable fabric than that of the lower, main portion of the front panel. By way of example, the lighter fabric is 235 gsm, providing added coolness and comfort to the user.

Because of the choice of fabrics, there is no need for shoulder straps to support the cups. Instead the portion 19 of each front panel 16 that extends from seam 28, 28' to apex 30, 30', where it joins back panel 18, provides tension that causes the cup to lift around the wearer's breast, supporting it in desired orientation, instead of flattening it against the wearer's torso or allowing it to hang over the wiring elements 32, 32'.

In the preferred embodiment described with reference to FIG. 1, the fabric for the front and back panels of the garment disclosed has a higher density than the fabric used in the side panels. The relative density difference provides a structure that facilitates body movement, without leading to undesired displacement of the garment—and particularly of the front panel—relative to the wearer's torso. In other words, this arrangement assists in retaining the cups in their breast-receiving, supportive position. This is advantageous to the wearer when engaging in boisterous activities in the surf, such as wave jumping, diving into or under breaking waves, and body surfing. The wearing of this garment enables a mother to feel free and confident to join her children in surf fun of this nature without having to feel apprehensive that her bikini top may be displaced, or lost, or that she would be at elevated risk of sunburn and related skin damage.

The preferred density range of the fabric for the front and rear panels is from 200 gsm to 500 gsm and more preferably from 300 to 400 gsm. The preferred density range for the side panels and sleeves is from 80 to 360 gsm and more preferably from 180 to 300 gsm.

A fabric suitable for forming the side panels is 'P GGT5' and sold under the trade mark SENSITIVE PLUS UNITO BONDED, also by Eurojersey SPA (above). Its elasticity measurements are tabulated as follows:

| Elasticity dynamometer | Force [N] | Width [cm] | Toll.+/− | Length [cm] | Toll.+/− |
|---|---|---|---|---|---|
| Extension BS 14704-1:2005 | 15.0 | 80 | 20% | 60 | 20% |

This fabric provides a greater degree of elasticity and stretch than the denser fabric used for the back and front panels. Providing the more stretchable fabric in the side panels than in the back and front was found surprisingly to assist in keeping the garment close to the wearer's body, compared with a prototype having a shell made entirely of the BFT2 340 gsm fabric. The prototype was found to be too stiff on the arms and to apply excessive structure to the body. The less stretchable fabric was not pulling the garment in tightly enough to the wearer's torso. The remedy would have been to make the fit smaller and thus uncomfortable.

Changing the sides and arms to the less dense, more stretchable, 250 gsm fabric assisted in pulling in the garment closer to the body without needing to make the fit uncomfortably smaller. This difference in relative density of the panels also assisted in keeping the underwire breast support closer to the wearer's body and in causing it to remain in place. The arms then also had more freedom of movement (e.g. for swimming) and also gave a closer, snug fit that was more comfortable and was more atheistically pleasing to the overall look of the garment.

Regarding the choice of fabric for the upper chest panel, a fabric that provides breathability may be selected. Such a fabric may have perforations comprising small laser-cut holes. For providing breathability combined with maximal sun protection, a 250 gsm fabric on the chest is an alternative solution.

The use of three sun protection fabrics of different density and stretch characteristics is found to achieve the goals of firm support, freedom of movement and a comfortable optimum fit for the wearer.

Although a density difference is preferred, the entire outer shell of the garment may be made of fabric of a single density throughout. Alternatively, the sleeves only may be made of higher or lower density material. A higher density fabric is even desirable if the garment is to be used in a particular sporting activity, such as surfing or body boarding, in which the wearer's arms may benefit from the added protection of the denser material, for example against chafing from the sides of the board when paddling.

It will be appreciated that for user confidence in extreme UV levels, as experienced by beach-goers in Australia, it is desirable for the fabric to be suitably protective. A sun protection factor of at least UPF 30 and preferably of UPF 50 or higher is desirable.

Figure 3:
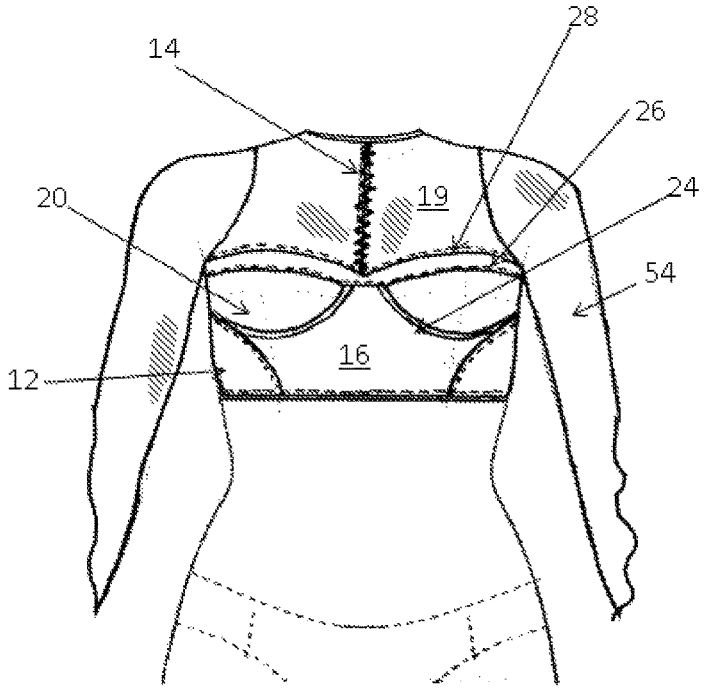
FIG. 3 provides (a) front and (b) rear views of an alternative embodiment of the outer garment of the invention.
Figure 3:
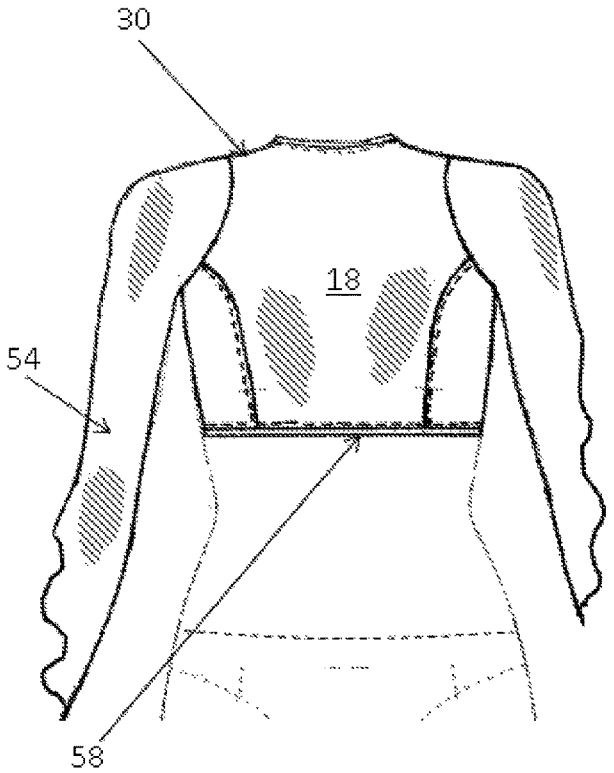

In an alternative embodiment, illustrated in FIG. 3, a swim top according to the invention is equipped with long sleeves 54 (shown truncated) in a crop top configuration ending above the waist of the wearer at lower hem 58. Like parts are designated with reference to the description given for FIGS. 1 and 2. In this embodiment, the back strap (not shown) is a single band of elastically resilient fabric that does not require a clasp.

In alternative embodiments, the strap may be in two portions instead of a single piece. The fastening means between the strap portions in these embodiments may, as an alternative to the clasp well known in the brassiere industry, be a hook-and-loop type fastener. This provides more size adjustment options than generally found in clasps, where hooking positions are at discrete intervals. It will be appreciated that it may be necessary for some wearers of the garment to lift the garment by or at its back panel in order to access the strap fastening. In other embodiments, the cups may be separated by fastening means with the structure having a continuous one-piece back strap.

The outer garment of this invention provides a close fit to the female body, resulting in a sculpted silhouette. The underwiring functions to provide the desired support, as in the case of a separate bra. With the zipper at the front the user can get easily in and out of the garment.

This invention addresses the discomfort faced by a women coming out of the water in a wet rash guard. Most rash guards typically use a fabric that does not dry quickly, giving the wearer the choice of

- keeping the wet rash guard on while evaporative drying takes place, cooling their body to the extent they feel cold, or,
- to avoid getting cold, taking the wet rash guard off and remaining in the sun in their bikini top. The bikini top itself may be cold, but at least the cold area is of reduced size. However, without the rash guard, they are no longer protected from the UV rays of the sun on their back, arms or chest. They are also less likely to want to put a wet rash guard back on.

The rash guard of the invention, being made from quick-dry fabric, does not afford its wearer time to get uncomfortably cold a short time after exiting the water. As it dries quickly, the wearer will be inclined to keep it on and hence enjoy continuing sun protection. This will avoid the incidence of sunburn occurring to those who may otherwise have removed their rash guard and forgotten to put it back on, failing perhaps to realise how quickly harmful sunburn can occur. As this invention has no separate bikini top underneath (as it is built-in), a modest woman will not be inclined to take the rash guard off and expose herself to the sun, but will be content to wear this quick drying and moisture-wicking garment throughout the duration of her sun exposure, and probably afterwards too. The rash guard of this invention should therefore not be considered as beachwear only, but as an item of general use leisure wear.

Constructed thus by including a bra underwire, the garment provides the bust both with support and lifting up against gravity.

Features of the invention thus include the following:

- Bra underwire inserted into the bra casing fabric that is then sewn in place with the bra wadding cup, so that it is one with the garment,
- A design that provides support, uplift against gravity and separation of the wearer's breasts,
- Uncompromising support not provided by any existing sun protection tops, and
- Sewn-in soft cups not found in existing rash guards and other active wear, constructed from a polymer foam padding chosen so that it smooths and shapes the bust.

The garments in the various forms of this invention will come in a variety of underwire and cup sizes to cater for the different breast sizes, e.g. cup size 10A, 10B, 12B, 12C, 14D, etc. The underwire may be of any self-supportingly rigid substance that is not incompatible with the wearer's skin and tissue, but is resistant to salt water (including perspiration). Preferably it also has excellent stability under exposure to ultra-violet radiation. Among metal substances, grade 316 stainless steel is preferred. The underwiring element may also be made of a plastics, including polycarbonates. The polycarbonate chosen should either be coated with a UV stabiliser, for instance if injection moulded, or be coextruded if produced by extrusion.

By way of example only, other plastics preferred for use in underwiring include thermoplastics, such as polyethylene—preferably high density polyethylene (HDPE)—and acrylics. Acrylic plastic rods may be heat formed to the desired underwiring shape, such as a general wide "U" for insertion immediately below the cup in the bra structure.

In an further embodiment of the invention, the bra foam cups optionally include an insert for an additional foam or gel mould to provide extra fullness to make the wearer's breasts appear larger.

The garment of the invention may be in a crop top form, as mentioned above, as well as in a series of longer forms to the waist and below, for example to cover the wearer's belly region, even down to the thighs. The longer embodiments provide sun protection over lower portions of the wearer's body.

These embodiments merely illustrate particular examples of the product of the invention providing a women's outer garment suited for active wear while providing excellent bust support. With the insight gained from this disclosure, the person skilled in the art is well placed to discern further embodiments by means of which to put the claimed invention into practice.

The invention claimed is:

1. A sun protection outer garment with integrated bust support comprising;

a fabric shell, having an ultraviolet protection factor of at least 40, configured to substantially cover a wearer's shoulders and the wearer's back; and a pair of breast-receiving cups each including an underwiring element;

wherein the fabric shell and breast-receiving cups are continuously fastened together by internal and external stitching comprising a lower hem along a lower peripheral edge of each breast-receiving cup connected to lower front panels of the fabric shell, and an upper hem along an upper peripheral edge of each breast-receiving cup connected to upper front panels of the fabric shell, to provide stability and bust support in a single unit garment.

2. The outer garment according to claim 1 wherein the lower peripheral edge of each breast-receiving cup has an arc angle in a range from 130° to 200°.

3. The outer garment of claim 2 wherein the breast-receiving cups comprise an inner lining of a substantially non-stretching material.

4. The outer garment of claim 3 wherein the lining comprises a polymer foam.

5. The outer garment of claim 1 wherein each breast-receiving cup comprises a peripheral casing for receiving the underwiring element, wherein the underwiring element is of arcuate shape having an arc in a range from 160° to 180°.

6. The outer garment of claim 1 wherein the underwiring element comprises an alloy selected for biocompatibility with body tissue.

7. The outer garment of claim 1 wherein the fabric shell comprises a front panel, a rear panel and a pair of discrete side panels, each side panel being connected to the front panel and the rear panel, thereby to define a torso-receiving space.

8. The outer garment of claim 7 wherein the front and rear panels have a fabric density exceeding that of the side panels.

9. The outer garment of claim 7 wherein the side panels are of a more stretchable fabric than the back panel.

10. The outer garment of claim 7 wherein the lower front panels and the upper front panels comprise the front panel and comprise respective fabrics of different density.

11. The outer garment of claim 7 wherein the side panels have a fabric density in a range from 80 gsm to 360 gsm.

12. The outer garment of claim 7 wherein the front and rear panels have a fabric density in a range from 200 gsm to 500 gsm.

13. The outer garment of claim 1 further comprising a bridging connection having respective left and right portions extending from respective proximal breast-receiving cup edges to a zipper located in the fabric shell between the cups and extending from an upper neckline to a lower hem.

14. The outer garment of claim 1 further comprising a back strap extending around the wearer's back and having opposed ends connected by stitching to available distal breast-receiving cup edges or to opposing side seams of the lower front panels or upper front panels, providing sideways pull and support to the breast-receiving cups.

15. The outer garment of claim 14 wherein the strap comprises a length of elastically resilient material.

16. The outer garment of claim 15 wherein the strap consists of a single length of elastically resilient material.

17. The outer garment of claim 14 wherein the strap is free of direct attachment to the rear and side panel outer shell.

18. The outer garment of claim 1 wherein the fabric shell comprises a 4-way stretch fabric.

19. The outer garment of claim 1 comprising left and right sleeves extending from the fabric shell.

* * * * *